United States Patent [19]

Upchurch et al.

[11] 4,370,719

[45] Jan. 25, 1983

[54] CONTROL OF CENTRIFUGAL PIPE CASTING OPERATION

[75] Inventors: Thurman H. Upchurch, Lynchburg; Gerardo A. Bianco, Jr., Madison Heights, both of Va.

[73] Assignee: AMSTED Industries Incorporated, Chicago, Ill.

[21] Appl. No.: 207,389

[22] Filed: Nov. 17, 1980

[51] Int. Cl.[3] ..... G06F 15/46; B22D 13/02

[52] U.S. Cl. ..... 364/472; 164/154; 164/157

[58] Field of Search ..... 364/472, 569; 164/3, 164/114, 117, 150, 154, 157, 286, 301

[56] References Cited

U.S. PATENT DOCUMENTS

| | | | |
|---|---|---|---|
| 2,943,369 | 7/1960 | Szwed | 164/157 X |
| 3,478,808 | 11/1969 | Adams | 364/476 X |
| 4,036,279 | 7/1977 | Nieman | 164/157 X |
| 4,316,495 | 2/1982 | Pierrel | 164/301 X |

*Primary Examiner*—Jerry Smith

*Attorney, Agent, or Firm*—Edward J. Brosius; Fred P. Kostka; Tony T. Shu

[57] ABSTRACT

Control is provided over the casting of iron pipe in a centrifugal casting machine. The initial flow of molten iron from the pouring ladle into the trough actuates an electric eye. A second electric eye is actuated when the molten iron has flowed to the end of the trough. The centrifugal casting machine is rolled up to surround the trough, the bell end of the pipe to be formed being at the end of the trough. A computer is utilized to determine the velocity of the iron on a real time basis. This iron flow information is analyzed to calculate the bell flag time by a previously determined algorithm which takes into account the casting machine and the pipe size being cast. The bell flag time is the time in which the molten iron is allowed to flow into the bell section of the pipe being cast, before the casting machine is moved away from the trough end to form the rest of the pipe.

5 Claims, 3 Drawing Figures

CONTROL OF CENTRIFUGAL PIPE CASTING OPERATION

BACKGROUND OF THE INVENTION

The present invention relates to the casting of iron pipe in a centrifugal casting machine. More specifically, this invention relates to the computer control of the casting process, whereby uniform bell ends of the cast pipe can be formed.

The centrifugal casting of iron pipe is accomplished by the use of a centrifugal casting machine. The machine comprises a rotating mold which is rollable toward and away from an iron trough which is adapted to be inserted into the rotating mold. Molten iron is poured from a ladle into the iron trough and pours out of the end of the trough into the rotating mold. The end of the pipe first formed is the bell end which has a core therein to insure the accurate forming of the bell end of the pipe. However, the core does not extend past the bell end into the length of the pipe. Accordingly, if the casting machine is moved away from the end of the iron trough too soon or too late, the portion of the pipe length adjacent the bell end of the pipe will be either too thin or too thick, and the pipe will be scrap. The rate at which the casting machine mold is moved away from the iron trough end is determined by the design of the casting machine. For the present invention, this rate of movement is assumed to be a manually adjustable constant; once the bell forming time has elapsed, the machine is moved away from the trough to form the length of the pipe. The movement of the casting machine is accomplished by either a hydraulic cylinder, a hydraulic or electrical motor, or a combination of these devices. It is to be understood that in certain casting machines, the casting machine itself remains stationary, and the iron trough is moved away from the casting machine. The principles of the present invention are equally applicable to such an arrangement.

A major problem in the centrifugal casting process used to produce thin wall cast iron pipe is the control of the bell end wall thickness. Variations of parameters associated with both the molten iron such as temperature and the casting machine such as mold condition contribute to the unpredictability of the bell end wall thickness. During the formation of an 8 inch (20.3 cm.) diameter pipe bell end, approximately 80 pounds (36.4 kg.) of iron per second flow into the pipe mold. For a 24 inch (61 cm.) diameter pipe, initial flow rates are about 200 pounds (90.0 kg.) of iron per second. A core is present to form the bell, but the core does not extend into the laying length of the pipe directly adjacent the bell. Consequently, due to the high iron flow rate and the absence of the core in the pipe length, the dwell time of the casting machine in forming the actual bell is critical to wall thickness. Due to the magnitude of the flow parameters and the fact that the tolerances in wall thickness for cast iron water pipe are from 0.04–0.08 inch (0.10–0.20 cm.), it is all but impossible to expect a human to be able to accurately control the casting operation.

Two methods are presently in use to control the dwell time of the casting machine in forming the bell end of the pipe. The manual reverse method has been in use since the invention of the centrifugal casting machine. This method is dependent upon the visual response of the machine operator to determine the changes in the molten iron and casting machine parameters and to start the casting machine rolling away from the pouring trough to form the length of the pipe. As expected, this system results in large variations in pipe wall thicknesses and unacceptable amounts of scrap pipe.

A second method utilizes a timer triggered by an electric eye aimed to sight the molten iron entering the mold. Bell forming dwell time is set by the operator prior to the start of the pouring. The operator's expertise is necessary to set the dwell time according to changes in the iron and machine parameters. This method shows improvement over the manual reverse method, but changes in the pouring cadence, iron control and machine control can contribute to unacceptable results similar to the manual reverse method.

Of course it is the volume of iron which flows during the bell forming time that determines whether the bell end will be properly formed. Attempts to measure this volume of iron and so control the movement of the casting machine have failed due to the destructive nature of the molten iron. Almost any sensing device placed in the iron is destroyed. Further attempts at establishing the iron flow rate by determining the chemical and physical characteristics of the molten iron have proved inaccurate due to the changes in the iron chemistry from batch to batch and in the steadily decreasing temperature of the molten iron. The temperature of the iron trough also affects the iron flow rate. These attempts have failed to produce an accurate pouring control further because they do not provide an analysis of the actual flow or iron being used in the real time sense of the present pipe being formed, but rather usually are based on a calculation of the pouring of the previous pipe.

A problem exists in the centrifugal casting or iron pipe in determining the time period during which the casting machine should not be moved to allow the bell end of the pipe to be formed within allowable tolerances.

Accordingly, it is an object of the present invention to provide an accurately controlled centrifugal pipe casting process.

SUMMARY OF THE INVENTION

The present invention provides a method and an apparatus for the automated control of the centrifugal casting or iron pipe.

The time during which the casting machine is not moved after pouring is initiated has been found to be critical to the formation of the bell end of the pipe. This time is called the bell forming dwell time or the flagging time for the pipe. The reason that this time is so critical is that the molten iron flows extremely rapidly, and the starting of the casting machine rolling away from the end of the iron trough a fraction of a second too soon or too late can result in a scrapped pipe due to too thin or too thick a pipe section adjacent to the bell end.

It has been discovered that the amount of iron that flows during any particular pouring is proportional to the time that the molten iron takes to run through the iron trough. The length of the iron trough is known, and the amount of iron that will flow through the trough in a given time is directly proportional to that time.

Accordingly, the present invention for measuring the molten iron velocity by measuring the time elapsed for the iron to pass between two relative points on the iron trough of the casting machine. Two photoelectric cells provide the signals when the iron begins to flow over the lip of the downchute and also when the iron reaches the end of the trough over which the casting machine mold has been rolled. Once this time is determined by the comparison of the two signals, the optimum bell forming time is calculated on a real time basis for the exact pipe being cast by a computer programmed to calculate such bell forming times for each pipe size and class once given the input of the iron velocity.

The control of the centrifugal casting operation is accomplished by a computer. Bell forming time algorithms are developed and stored in the computer for each casting machine and for each pipe size and class. For a target iron velocity, a target bell forming time is established and stored in the computer. The actual iron velocity measured for each particular pipe being cast is compared with the target iron velocity. If the actual velocity is greater than the target velocity, the bell forming time will be automatically decreased by the computer, and the casting machine will be rolled away from the iron trough sooner to form the length of the pipe. This avoids the pipe wall near the bell end from being too thick. If the actual velocity is less than the target velocity, the bell forming time will be automatically increased by the computer, and the casting machine will not be rolled away from the iron trough until additional iron flows to form the length of the pipe. This avoids the pipe wall from being too thin.

The present invention provides an accurate control over the centrifugal casting of iron pipe. The molten iron velocity is measured on a real time basis for each pipe as it is being cast, and the optimal bell forming time is computed. This information is relayed to the casting machine, which is rolled away from the iron trough to form the length of the pipe after the bell end of the pipe has been formed.

It should be understood that the principles of the present invention are equally applicable to the pipe casting machines where the casting machine itself remains stationary but the iron trough itself is movable away from the casting machine. In such a case, the movement of the iron trough would be controlled.

DESCRIPTION OF THE PREFERRED EMBODIMENT

Figure 1:
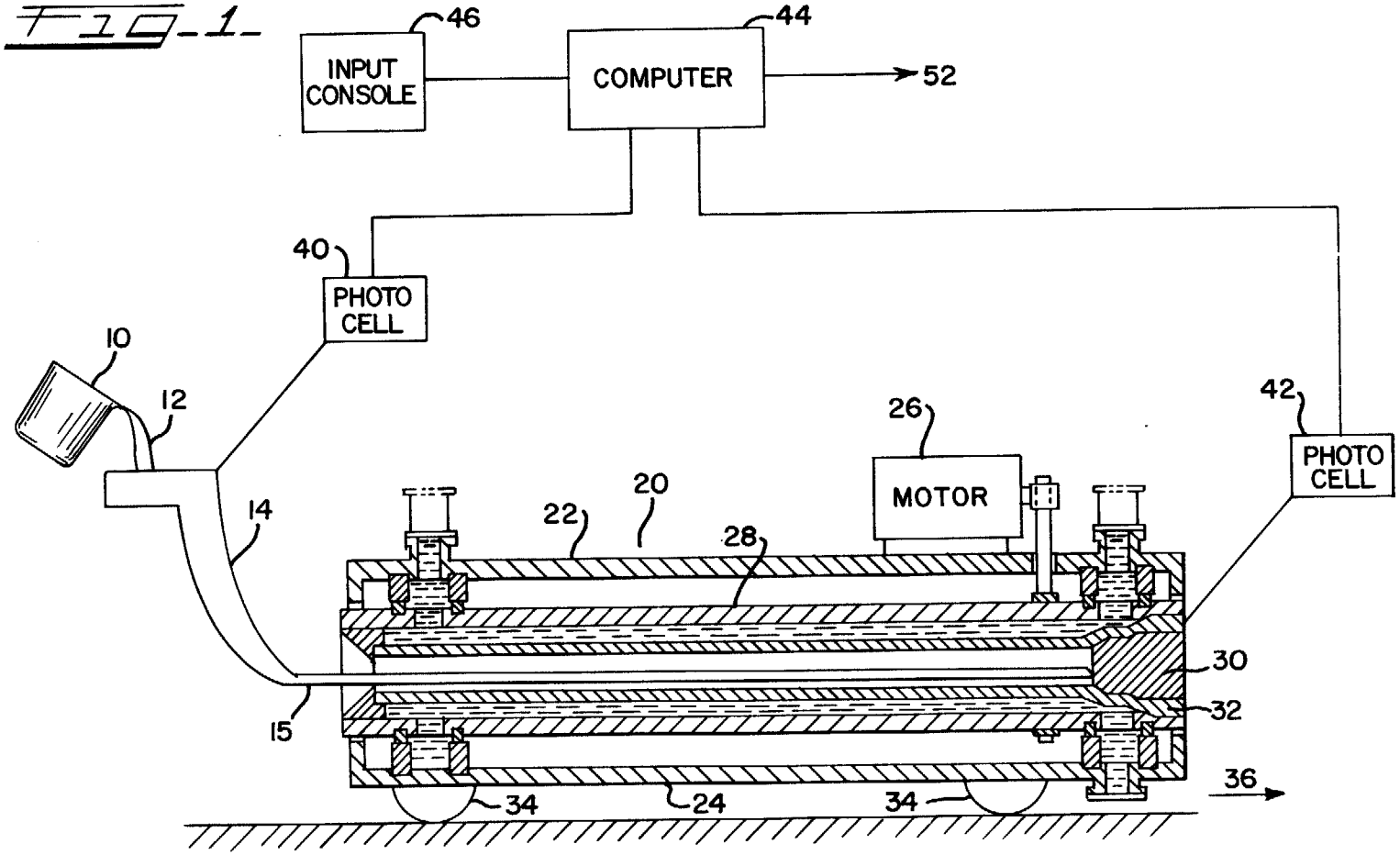
FIG. 1 is a diagrammatic view of a centrifugal casting machine having the control circuitry of the present invention.

Referring to FIG. 1, there is shown a diagrammatic view of a centrifugal casting machine with the control circuit of the present invention. The molten iron ladle 10 contains molten iron 12 which is poured into iron downchute 14. Molten iron 12 flows from iron downchute 14 into iron trough 15. Casting machine 20 comprises a top frame 22 and bottom frame 24. Motor 26 is affixed to top frame 22 for rotating mold 28. Core 30 is held in the bell end of the casting mold 28 to form the bell end 32 of the pipe casting. Casting machine 20 is mounted on wheels 34 which enable casting machine 20 to roll in the direction of arrow 36. Casting machine 20 is held in the full iron trough 15 inserted position by a release mechanism (not shown). Such release mechanism is usually a hydraulic brake. Casting machine 20 is rolled into the full iron trough insert position shown in FIG. 1 by a drive system such as a hydraulic cylinder or hydraulic or electric motor (not shown), and by the engaging of the release mechanism, casting machine 20 is held in this position. Upon the disengaging of the release mechanism, casting machine 20 is rolled in the direction of arrow 36 by the drive system. Because iron trough 15 does not move, the length of the pipe being cast is so formed during the rolling movement of casting machine 20. In an alternative embodiment of the present invention, the casting machine is stationary and the iron trough is movable.

A photoelectric cell 40 is positioned to provide a signal where molten iron 12 first passes into iron downchute 14. This signal is transmitted to computer 44. A second photoelectric cell 42 is positioned to provide a signal when molten iron 12 first enters the pipe casting mold where bell end 32 of the pipe casting is being formed.

Input console 46 is utilized to store standard bell forming times for each casting machine controlled and for each pipe size and class. It is possible for a single computer 44 to control several casting machines 20.

Figure 2:
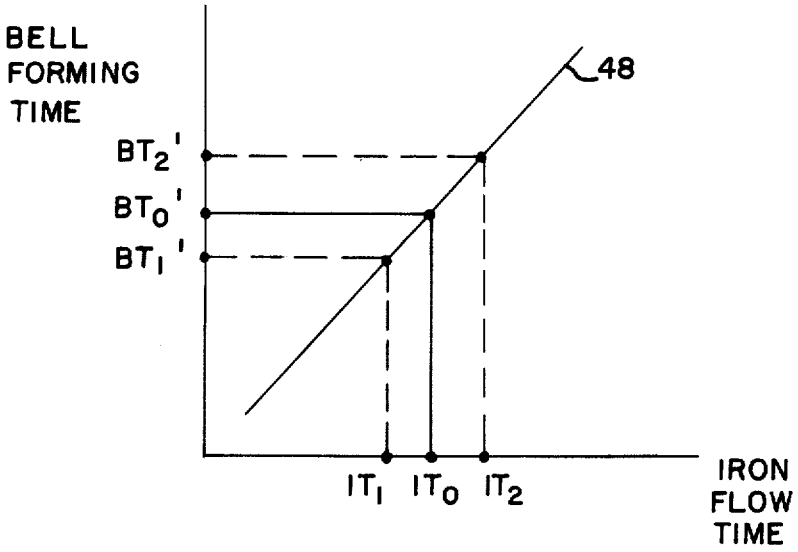
FIG. 2 is a diagram of the relationship between iron flow time and bell forming time for a typical cast iron pipe.

As shown in FIG. 2, the relation between iron flow time and bell forming time is shown as a straight line 48. This linear relation is shown for simplicity of explanation; the relation between iron flow time and bell forming time for each size and class of pipe and for each casting machine may be much more complex than a simple linear relationship.

In computing the bell forming time, the computer has stored a standard bell forming time BTo' for a given pipe size and class and for a particular casting machine. The iron flow time for that casting machine is also stored in the computer as ITo. When the signals from photoelectric cells 40 and 42 are compared, the actual iron flow time is easily calculable on a real time basis for the actual pipe being cast.

For example, if the actual iron flow time is less than the standard time, which is to say that the time between photoelectric signals is less than the standard time, this decreased flow time is shown ias IT1 in FIG. 2. The computer stored relationship between iron flow time and bell forming time would automatically decrease the bell forming time to BT1'. A signal 52 would be sent from computer 44 to the casting machine release mechanism at time BT1' to disengage the mechanism and permit casting machine 20 to be rolled in direction 36. This action would prevent too thick a pipe wall from being formed in the pipe length near bell end 32.

If the actual iron flow time is greater than the standard time, the time between photoelectric signals would be greater than the standard time. This increased flow time is shown as IT2 in FIG. 2. The computer stored relationship between iron flow time and bell forming time would automatically increase the bell forming time to BT2'. A signal 52 would be sent to the casting machine release mechanism at time BT2' to disengage the mechanism and permit casting machine 20 to roll in direction 36. This action would prevent too thin a pipe wall from being formed in the pipe length near bell end 32.

In simple terms, the relation between iron flow time IT and bell forming time BT is linear. In the following expression, ITs is the standard iron flow rate for the particular casting machine, ITA is the actual iron flow time measured by the photoelectric cells, BTs is the standard bell forming time for the particular casting machine and for the size and class of pipe being cast and BTA is the optimum bell forming time given the actual iron flow time:

$$BTA = BTs + K(ITA - ITs)$$

If the actual iron flow time as measured is greater than the standard flow time, the actual bell forming time will be increased to compensate for the more slowly flowing iron. If the actual iron flow time as measured is less than the standard flow time, the actual bell forming time will be decreased to compensate for the faster flowing iron. The constant K is determined from a study of the particular casting machine and the size and class of pipe being cast.

Figure 3:
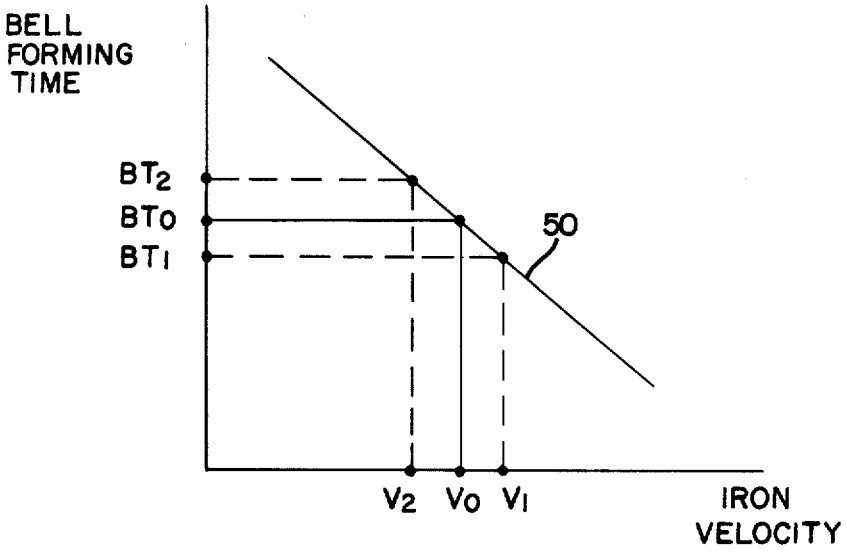
FIG. 3 is a diagram of the relationship between iron velocity and bell forming time for a typical cast iron pipe.

It is axiomatic that the difference in iron flow times can be used to calculate the iron flow velocity. As shown in FIG. 3, the relation between iron velocity and bell forming time is shown as a straight line 50. This linear relation is shown for simplicity of explanation; the relation between iron velocity and bell forming time for each size and class of pipe and for each casting machine may be more complex than a simple linear relationship.

In computing the bell forming time, the computer has stored a standard bell forming time BTo for a given pipe size and class and for a particular casting machine. The iron velocity for that casting machine is also stored in the computer as Vo. When the signals from photoelectric cells 40 and 42 are compared, the iron velocity is easily calculable on a real time basis for the actual pipe being cast.

For example, if the actual iron velocity is greater than the standard velocity, this increased velocity is shown as V1 in FIG. 3. The computer stored relationship between iron velocity and bell forming time would automatically decrease the bell forming time to BT1. A signal 52 would be sent from computer 44 to the casting machine release mechanism at time BT1 to disengage the mechanism and permit casting machine 20 to be rolled in direction 36. This action would prevent too thick a pipe wall from being formed in the pipe length near bell end 32.

If the actual iron velocity is less than the standard velocity, this decreased velocity is shown as V2 in FIG. 3. The computer stored relationship between iron velocity and bell forming time would automatically increase the bell forming time to BT2. As signal 52 would be sent to the casting machine release mechanism at time BT2 to disengage the mechanism and permit casting machine 20 to roll in direction 36. This action would present too thin a pipe wall from being formed in the pipe length near bell end 32.

In its simplest terms, the relation between iron velocity and bell forming time BT is a linear one. In the following expression, Vs is standard iron velocity for the particular casting machine, VA is the actual iron velocity measured by the photoelectric cells, Ts is the standard bell forming time for the particular casting machine and for the size and class of pipe being cast and TA is the optimum bell forming time given the actual iron velocity:

$$TA = Ts + K'(Vs - VA)$$

If the actual iron velocity as measured is less than the standard velocity, the actual bell forming time will be increased to compensate for the more slowly flowing iron. If the actual iron velocity as measured is greater than the standard velocity, the actual bell forming time will be decreased to compensate for the faster flowing iron. The constant K' is determined from a study of the particular casting machine and the size and class of pipe being cast.

Of course, the relation between iron flow time or velocity and bell forming time is not necessarily linear. Only a study of the particular casting machine to be controlled can produce the particular relations. However, what is important is that the only input that need be studied is the iron flow time or velocity. Once the time difference is known, the velocity is of course proportional to the inverse of this time difference. Complex measurements of the volume of iron being poured are not required to control the centrifugal casting process. For any casting machine, the volume of iron which flows in any given time period is the same, within acceptable limits. Once the time difference is known, the centrifugal casting process can be controlled in the aspect of exactly determining when the pipe bell has been accurately formed and the casting machine should be allowed to be rolled away from the iron trough and thusly form the rest of the length of the pipe. Of course, it is also within the scope of the present invention to have a stationary casting machine and a movable iron trough. In such a case, the movement of the iron trough would be controlled.

What is claimed is:

1. A method for controlling the centrifugal casting of a metal pipe including the steps of:

obtaining a first photoelectric cell signal when molten metal passes into a pouring trough, obtaining a second photoelectric cell signal when molten metal passes to the end of the casting mold at the end of the pouring trough, comparing said first and second photoelectric cell signals to determine the actual metal pouring flow time, comparing the actual pouring flow time with a stored standard pouring flow time, increasing the bell end forming time for the metal pipe when the actual measured pouring flow time is greater than the standard pouring flow time, and decreasing the bell end forming time for the metal pipe when the actual measured pouring flow time is less than the standard pouring flow time.

2. A method for controlling the centrifugal casting of a metal pipe including the steps of:

pouring molten metal into a metal trough, obtaining a first sensing signal that the metal has entered the trough, having the molten metal flow through the metal trough to the end of the trough at the bell end of the pipe being cast, obtaining a second sensing signal that the metal has flowed to the end of the trough, comparing the first sensing signal and the second sensing signal to determine the actual time for the metal to flow through the trough, comparing the actual metal flow time with a stored standard time and decreasing the time for forming the bell end of the pipe being cast if the actual metal flow time is less than the standard time and increasing the time for forming the bell end of the pipe being cast if the actual metal flow time is greater than the standard time.

3. A method for controlling the centrifugal casting or iron pipe, including the steps of:

pouring molten iron into an iron trough, generating a first sensing signal when the molten iron enters the trough, allowing the molten iron to flow through the iron trough about which a centrifugal casting machine has been rolled, generating a second sensing signal when the molten iron reaches the end of the iron trough and begins to form the bell end of the pipe being cast, comparing the first sensing signal and the second sensing signal to determine the actual iron flow time, utilizing a computer to determine the difference between the actual iron flow time and a standard iron flow time stored in the computer, modifying a standard bell forming time stored in the computer as a function of the difference between the actual iron flow time and the stored standard iron flow time to produce a modified bell forming time, generating an output signal from the computer to a release mechanism, and moving the casting machine and the iron trough relative to each other upon release from the release mechanism at the expiration of the modified bell forming time.

4. An apparatus for the controlling of a centrifugal pipe casting machine including:

a centrifugal casting machine with a rotatable mold therein, a metal trough about which the rotable mold and centrifugal casting machine is capable of being rolled, a release mechanism which when engaged holds the casting machine about the metal trough and when disengaged allows the casting machine and the iron trough to move relative to each other, a first sensing device which provides a first signal when molten metal first enters the metal trough, a second sensing device which provides a second signal when the molten metal has flowed the entire length of the metal trough and has begun to form the bell end of the pipe being cast, a computer means for comparing the first and second signals and determining the actual metal flow time, for comparing the actual metal flow time with a stored standard metal flow time, for utilizing the difference between the actual metal flow time and the standard metal flow time to modify a standard bell forming time stored in the computer means to produce a modified bell forming time, and for generating a signal to disengage the casting machine release mechanism at the end of the modified bell forming time.

5. An apparatus for controlling a centrifugal pipe casting machine including:

a first sensing means to provide a first signal when molten metal first enters a pouring trough of a casting machine, a second sensing means to provide a second signal when molten metal reaches the end of the pouring trough and begins to form the bell end of the pipe being cast, a computer means for receiving and comparing the first and second signals to determine the actual metal flow time, for comparing the actual metal flow time with a stored standard metal flow time, for utilizing the difference between the actual metal flow time and the standard metal flow time to modify a standard bell forming time stored in the computer means to produce a modified bell forming time, and for generating a signal to disengage a release mechanism to permit the casting machine and the pouring trough to move relative to each other and thusly form the length of the pipe being cast.

* * * * *